United States Patent [19]

Babler

[11] 4,064,799

[45] Dec. 27, 1977

[54] PRINT HAMMER BUMPER EXHIBITING DUAL RESILIENCY CHARACTERISTICS

[75] Inventor: Egon S. Babler, Northbrook, Ill.

[73] Assignee: Teletype Corporation, Skokie, Ill.

[21] Appl. No.: 745,013

[22] Filed: Nov. 26, 1976

[51] Int. Cl.[2] ..... B41V 9/00

[52] U.S. Cl. ..... 101/93.02; 197/93.14; 109/42

[58] Field of Search ..... 101/93.02, 93.03, 93.14; 197/42; 335/257, 277; 267/140, 141, 152, 153

[56] References Cited

U.S. PATENT DOCUMENTS

| | | | |
|---|---|---|---|
| Re. 27,175 | 9/1971 | Arnold et al. | 101/93.02 X |
| 3,144,821 | 8/1964 | Doejza | 101/93 |
| 3,386,376 | 6/1968 | Mutz et al. | 101/93.02 |
| 3,636,868 | 1/1972 | Johnston et al. | 101/93.02 X |
| 3,742,848 | 7/1973 | Huntoon et al. | 101/93 C |
| 3,785,283 | 1/1974 | Kearney | 101/93 C |
| 3,795,187 | 3/1974 | Babler | 101/93 C |
| 3,805,695 | 4/1974 | Babler | 101/93 C |
| 3,823,667 | 7/1974 | Babler | 101/93 C |
| 3,825,103 | 7/1974 | Riley | 197/164 |
| 3,964,384 | 6/1976 | Johnston | 101/93.02 X |

*Primary Examiner*—Edward M. Coven
*Attorney, Agent, or Firm*—W. K. Serp; J. C. Albrecht

[57] ABSTRACT

A print hammer bumper for an on-the-fly impact printer which includes a hammer mechanism having a plurality of print hammers disposed in a linear array. The bumper serves to automatically adjust the forward force of the hammer to the number of paper plys being printed and to dampen the rebound energy of the hammer return stroke. The bumper is in the form of an elongated material having two portions each exhibiting different characteristics. A first portion of the bumper, which is positioned to engage each of the print hammers during their forward printing stroke, exhibits a hardness characteristic such that it readily compresses to adjust the printing force to the number of paper plys being printed. A second portion of the bumper exhibits a low resiliency characteristic and is positioned to engage the hammers upon their return or rebound stroke so as to absorb the hammer rebound energy, thus preventing character overprint by a rebounding hammer again striking the paper.

9 Claims, 4 Drawing Figures

PRINT HAMMER BUMPER EXHIBITING DUAL RESILIENCY CHARACTERISTICS

FIELD OF THE INVENTION

This invention generally relates to a printer wherein the printing impressions are formed by a plurality of print hammers selectively striking a print medium and more particularly relates to an energy absorbing print hammer bumper for such a printer.

BACKGROUND OF THE INVENTION

Impact printers of the type with which the present invention is primarily concerned effect printing "on-the-fly" at relatively high speeds. In such printers the character dies or type are mounted in a longitudinal array on a continuously moving carrier. The carrier is drawn past an aligned array of selectively actuable print hammers. Interposed between the character dies and the print hammers is a print medium in the form of a paper sheet and a reversibly driven ink or carbon impregnated ribbon. The type characters are struck when they are in motion with the energy for impacting delivered by an inertial hammer mechanism. An inertial hammer mechanism is one wherein the hammer is thrown much in the manner of a projectile by a hammer operator such as an electromagnet. The hammers are individually subjected to an abrupt impact force and propelled against the paper under their own momentum.

In order to maximize printing speed, the hammers should have a low mass and be propelled at high speed with minimal friction. While such hammer operation is conducive to high speed printing, it has heretofore imposed a serious problem in regard to effectively damping the kinetic energy of the hammer return force, so as to reduce hammer rebound. Such rebound forces are often augmented by a hammer return spring. If these return forces are not absorbed or damped, they can very readily cause a given print hammer, after reaching a backstop, to rebound off the backstop in a forward direction with sufficient velocity to again strike the paper producing undesired character images resulting in blurred print or ghosting.

Several approaches have been suggested for reducing the rebound motion of the hammers. One class of printers uses the magnetic attractive force of core pole faces of an energized solenoid to effect the "firing" of an associated hammer. A predetermined amount of current is maintained in the solenoid coil during the rebound return of the hammer thus producing a dynamic braking action against the returning hammer. A particular disadvantage with such an arrangement is that the duty cycle of the solenoid is greatly increased as is the power consumption of the system.

In other systems, the armature of the solenoid is used directly or indirectly, through a coupled actuator, to "fire" the associated hammer. A second electromagnet has been employed to magnetically attract the rebound-returned hammer against an associated backstop from which the hammer is again fired. With such an arrangement the hammer mechanism is relatively complex increasing cost and further necessitating a substantial increase in the current requirements of the print hammer drive circuitry.

A simplified approach utilizes a resilient shock absorbing bumper positioned to absorb the rebound forces of the hammer. Such a structure is described in U.S. Pat. No. 3,994,218 issued Nov. 30, 1976 to Arthur F. Riley and entitled "Energy Absorbing Print Hammer Bumper with Internal Stabilizer." A similar resilient bumper is described in U.S. Pat. No. 3,823,667 issued July 16, 1974 to E. S. Babler entitled "Force Adjustment in Impact Printers." It will be appreciated that the material used for such a rebound absorbing bumper must absorb a great portion of the rebound energy; that is, it should possess a relatively low resiliency.

On-the-fly printers are frequently used to print through multiple paper sheets interleaved with carbon paper. Usually, means are provided permitting the operator to manually adjust the hammer force to correspond with the number of layers being printed. If excessive force is applied to a single sheet, the paper and/or ink ribbon may be cut and conversely insufficient force applied to a multiple ply copy will produce faint print on the copy. An automatic means for adjusting the forward hammer pressure applied to the paper is described by M. E. Bear and J. E. McGuire in an IBM Technical Disclosure Bulletin entitled "Print Hammer Impact Control Mechanism" (Vol. 5, No. 11, April 1963). As described in this publication, a fixed stop carrying a pad is positioned to absorb the forward impact of the hammer with the amount of energy absorbed being related to the thickness of the print medium. When multiple paper thicknesses are placed in the printer, the hammer strikes the paper on the print stroke before or quickly after reaching the pad and thus the hammer impacts the paper with substantially maximum force. However, when a single ply sheet is used, the hammer, on the forward stroke, hits the pad well before striking the paper and a relatively large portion of the impact energy is absorbed by the pad during its compression thus preventing the application of excessive force to the paper.

A similar print force adjusting arrangement is described in U.S. Pat. No. 3,144,821 issued to J. E. Drejza on Aug. 18, 1964 and entitled "Printer Apparatus Having Print Force Control." Both the Drejza and Bear references disclose apparatus wherein the compressible pad is positioned out of the direct path of the hammer return stroke since the resiliency of the pad is high and therefore would not adequately dampen the hammer energy on the return stroke. Thus, heretofore the dampening of the return stroke of the print hammer and the compensation or adjustment of the hammer forward stroke have frequently been viewed as independent problems necessitating separate solutions. A bumper fabricated of a single material as in the aforecited U.S. Pat. No. 3,823,667 will not adequately accomplish both objectives due to the different resiliency and hardness requirements which the two operations require. The illustrated embodiment of this invention provides a novel solution to both of these problems by utilizing a unitary bumper assembly for a printer which absorbs the hammer rebound energy as well as automatically adjusts the hammer printing force to the number of copy plys being printed. A particular feature of the apparatus is that both of these advantages are provided by a relatively simple unitary bumper which is relatively economical to fabricate and utilize.

SUMMARY

An improved bumper for an on-the-fly impact printer is described which includes a print hammer mechanism having a plurality of selectively actuable print hammers disposed in a lateral array with each hammer movable along a linear path for printing on a web composed of at least a single sheet of paper. The hammer exhibits a forward movement directed toward the paper web during printing and a rebound movement produced by the abrupt termination of the forward hammer movement upon completion of a printing operation. An improved bumper serves to automatically adjust the forward force of the hammer to the number of paper plys of the web and for damping the rebound energy of the hammer upon its return stroke. Further, the bumper is positioned to engage each of the print hammers during their forward stroke and also engage the hammers upon their return stroke. The bumper defines a first portion for engaging each of the hammers during their printing stroke which portion exhibits a hardness characteristic selected to reduce the forward impact force of each of the hammers upon the paper to that force necessary to produce an acceptable print upon each of the sheets in the web. The bumper defines a second portion for engaging each of the hammers during their return stroke which portion exhibits a relatively low resilience so as to quickly absorb the return forces of each hammer thereby greatly reducing the rebound of the hammer upon return to its non-print condition.

In accordance with the illustrated embodiment, each of the hammers defines an opening with the bumper positioned within the opening defined by each of the hammers so that a first edge of the opening strikes the first portion of the bumper during the forward print stroke of the hammer and the second edge engages the second portion during the return stroke of the hammer.

Preferably the first portion of the bumper has a Shore hardness characteristic in the range of 10A to 20A and the second portion exhibits a rebound efficiency of approximately 5 to 20 percent. It has been found that urethane elastomers selected to possess the desired characteristics when centrifugally cast into an elongated strip produce a bumper having the desired operational characteristics.

It is a main object of this invention to provide a print hammer bumper assembly which serves to effectively absorb the hammer rebound energy as well as adequately adjust the forward print force of the hammer. Other objects and advantages of the invention will be more readily appreciated after reference to the following description and accompanying drawings wherein:

DETAILED DESCRIPTION

Printer

Figure 1:
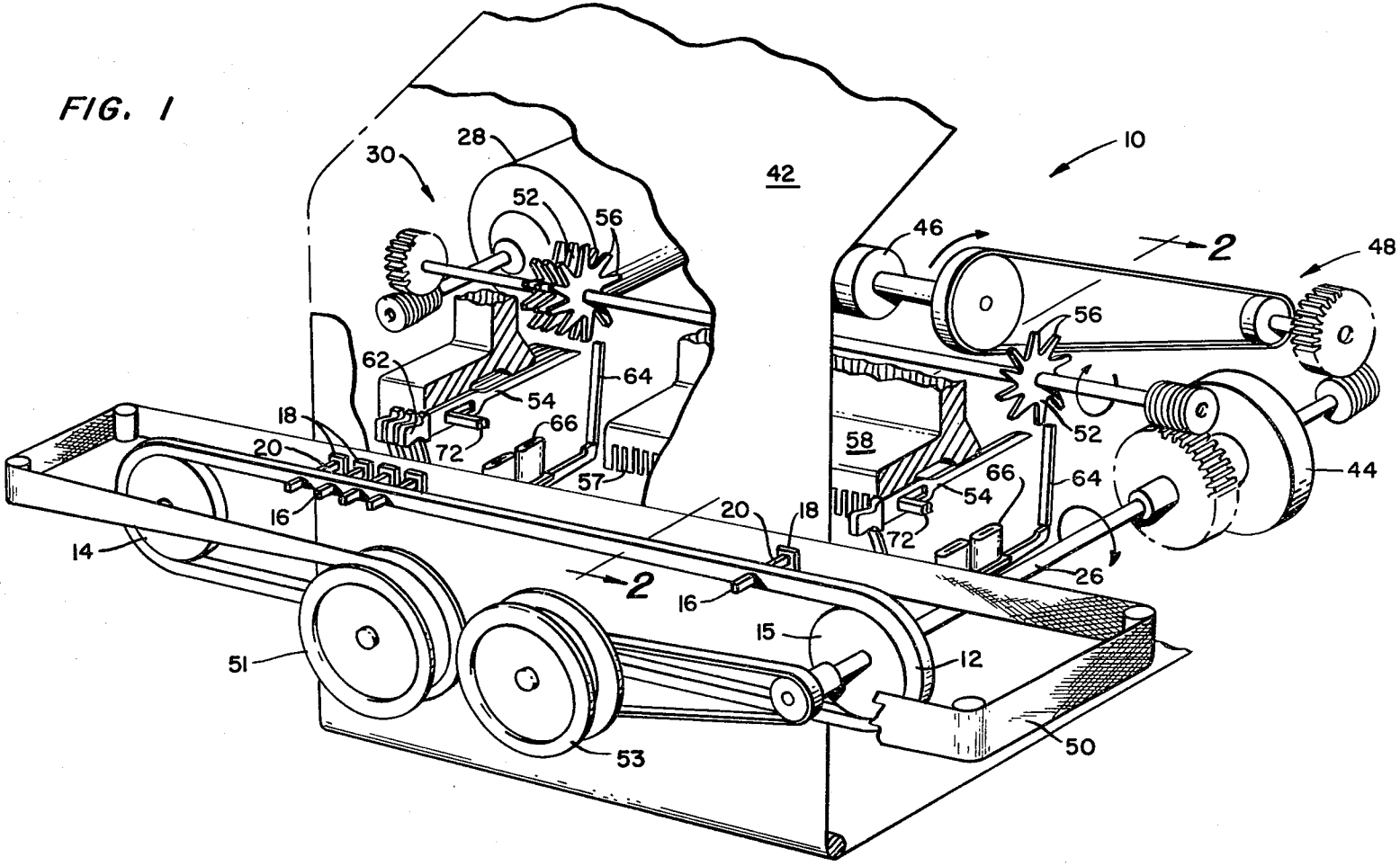
FIG. 1 is a partially broken away perspective view of a high speed impact printer, incorporating certain features of this invention, with certain components omitted for illustrational clarity.

Illustrated in FIG. 1, is a high speed, on-the-fly, impact printer 10. Such a printer is of the class that utilizes an endless type carrier 12 trained between a pair of spaced and aligned pulleys 14 and 15 which are journalled by suitable means on a main printer frame (not shown). The carrier 12 may be in the form of a chain or toothed belt adapted to transport a plurality of type pallets 16 in a circular path oriented to define upper and lower linear printing courses with the upper course being coextensive with the line print area of the printer. Each of the pallets 16 includes a front face portion 18 having a character die forming an integral part thereof. The pallets 16 are uniformly spaced along and oriented transversely of the carrier 12 by means of shank sections 20 which extend through openings formed in the carrier 12.

Figure 2:
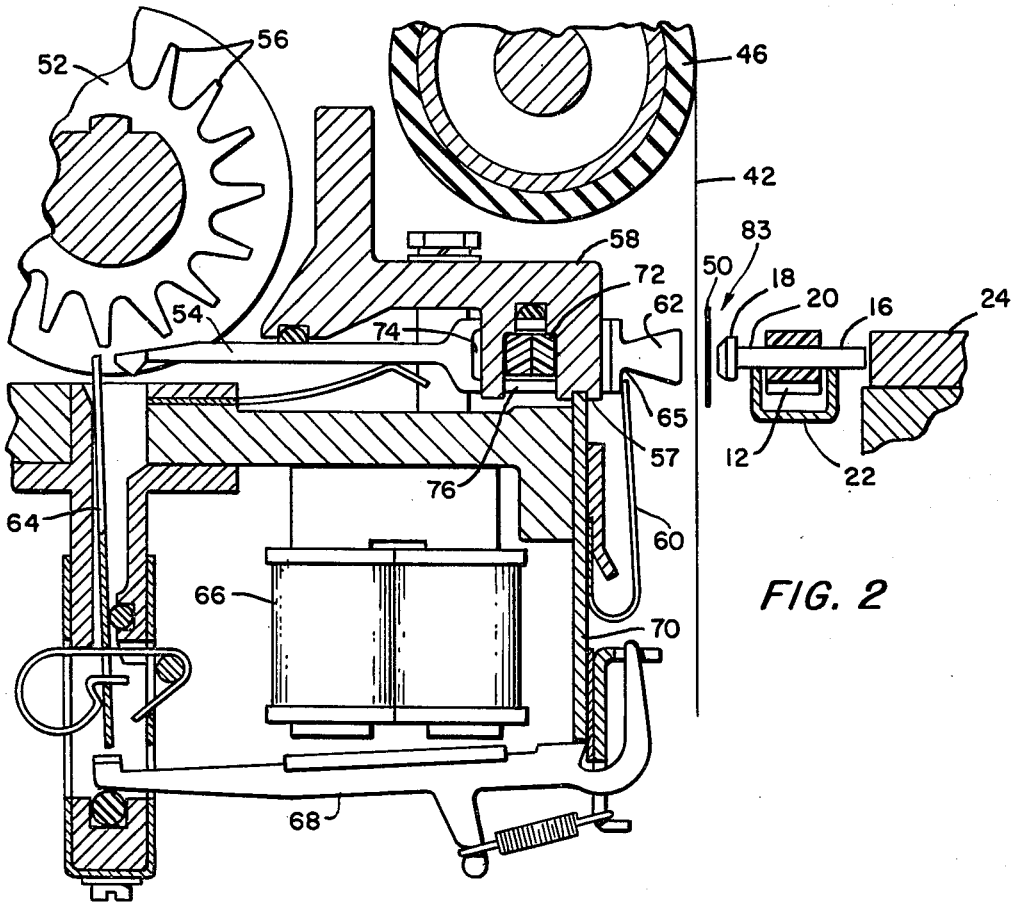
FIG. 2 is an enlarged sectional view taken along line 2—2 of FIG. 1 illustrating in greater detail a print hammer firing mechanism of the printer of FIG. 1.

The upper course of the carrier is guided along a U-shaped support member 22 illustrated in FIG. 2 with an adjustable back stop generally indicated by the reference numeral 24 and being employed to adjust the forward position of the aligned area of type pallets 16 transported on the carrier 12. The reader's attention is directed to U.S. Pat. No. 3,742,848 entitled "Endless Carrier Printer" by Huntoon and Kearney, wherein a more detailed description may be obtained with respect to the construction of a suitable carrier and type pallets for use in the illustrated embodiment.

Returning to FIG. 1, the printer 10 includes the spaced carrier pulleys which constitute idler 14 and drive 15 pulleys respectively. Driving torque is coupled to the drive pulley 15 through a shaft 26 which is coupled to a motor 28 through a drive train 30. The motor 28 also serves to provide drive to advance a printing web 42 which may take the form of a sheet of paper stored upon a roll (not shown). Alternately, several sheets or plys of paper may be simultaneously printed with carbon or other reproduction media interspersed between the paper sheets.

Frictional paper drive is accomplished through a clutch 44 which selectively couples a paper friction drive roller 46 to the motor 28. When the clutch 44 is energized, the motor 28 drives the roller 46 through a drive belt gear combination 48. For purposes of clarity, certain portions of the driving support structure including the main frame of the printer 10 have been omitted other than to the extent shown in fragmentary form in FIG. 2.

In order to effect printing of the characters on the web 42, an ink ribbon 50 transported between a pair of spools 51 and 53 is continuously driven in a desired direction between a position aligned with the array of type pallets 16 and the web 42. A preferred embodiment of an improved ribbon spool driving reversing tensioning mechanism suitable for use in the illustrated embodiment is disclosed in U.S. Pat. No. 3,825,103 entitled "High-Speed Printer Having Improved Ribbon Driving, Reversing and Tensioning Mechanism" by E. S. Babler.

With particular reference to FIG. 2, the hammer driving mechanism includes an array of spoke-like impellers 52 (only four of which are shown in FIG. 1) and a plurality of associated impact or print hammers 54. There is one impeller 52 and an associated hammer 54 for each possible print position or column on the web 42. Each impeller 52 defines a plurality of radially extending uniformly spaced spokes 56. The impellers 52 are preferably arranged in a manner as disclosed in U.S. Pat. No. 3,795,187 entitled "Impellers for Impact Printers" having a common inventor with this application. Each hammer 54 is positioned in guides defined by fingers 57 of a comb-like guide member 58 secured to the printer frame. A biasing spring 60 serves to maintain each hammer in its nonprint position. The limits of the hammer path length are defined between a normal untensioned or nonprint position illustrated in FIG. 2 and a print position wherein an enlarged forward head portion 62 of each hammer is propelled against the back side of the paper web 42. Additional details of the hammer mounting and actuating structure can be obtained from the aforementioned U.S. Pat. No. 3,823,667.

An interponent 64 is employed to translate the driving force of the associated impeller 52 to an aligned hammer 54 so as to propel the hammer 54 against the back side of the web 42. Each of the interponents 64 essentially comprises an elongated upright finger-like member operably associated with one particular impeller 52 and hammer 54. The interponents 64 are disposed in a lateral array, oriented essentially vertically and respectively aligned with the adjacent rearward ends of the horizontally disposed hammers 54. Each interponent 64, in response to a respectively and selectively energized one of a plurality of electromagnetic assemblies 66 and a responsively pivoting armature 68, can be actuated into either one of two operating positions. In a first or nonprinting position illustrated in FIG. 2, the upper end portion of each interponent 64 is lowered from the path of its associated impeller spoke 52. In the alternate position, the upper free end portion of each interponent 64 is vertically raised by the armature 68 into the path of movement of a then intermediately adjacent impeller spoke 52 in consequence of which printing occurs.

Serving to retract the hammer 54 after firing, is the leaf spring 60. The upper end of the longer leg of the leaf spring 60 is biased against an under cut shoulder 65 defined by the under-side of the enlarged forward portion of the hammer 54. The upper end of the shorter leg of the leaf spring 60 is rigidly secured to a front chassis 70 of the printer. Each leaf spring 60 is in a relatively unbiased condition when the associated hammer 54 is in its rearward nonprinting position and is in a heavily biased condition during printing. The rearward movement of the hammer 54 to its nonprinting position will not occur until after the rearward end of the hammer 54 has been released by its associated interponent 64 which condition occurs after the printing operation has been completed.

The electromagnetic hammer drive assemblies 66 are preferably constructed, arranged, and energized in the manner described in U.S. Pat. No. 3,785,283, entitled "Teleprinter Assembly" issued to J. F. Kearney on Jan. 15, 1974. Details of the manner in which the associated armatures are mounted are described in one preferred embodiment disclosed in still another U.S. Pat. No. 3,805,695 entitle "Armature Mounting Assembly for A Teleprinter" issued to E. S. Babler on Apr. 23, 1974. For information regarding the manner in which electromagnets may be selectively energized to effect the firing of their associated hammers may be found in U.S. Pat. No. 3,845,710 entitled "Print Control Logic Circuitry for On-the-Fly Printers" issued to D. A. Brodrueck on Nov. 5, 1974.

Bumper

Figure 3:
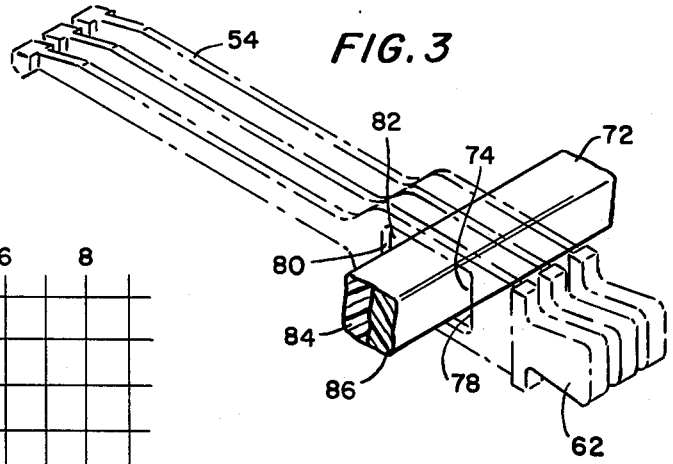
FIG. 3 is a perspective, enlarged detail view illustrating the energy absorbing print hammer bumper and cooperating print hammers of the printer of FIG. 1.

With particular reference to FIGS. 2 and 3, an elongated energy absorbing bumper 72 is illustrated which serves a two-fold purpose, namely that of absorbing the rebound energy of the hammers 54 after impacting the paper web 42 and additionally compressing to adjust the forward printing force of the hammers 54 to accommodate the number of paper plys being simultaneously printed. The bumper 72 is elongated having a square cross-sectional shape dimensioned to freely pass through a slot 74 cut into each of the hammers 54. These slots 74 are dimensioned relative to the cross-sectional dimensions of the bumper 72 so as to allow the necessary free reciprocal movement of the hammers 54 relative to the stationary bumper 72 during each print cycle. The bumper 72 is firmly retained in position at a plurality of discrete points along its length by the comb-like finger 57 of the guide member 58. As previously mentioned, the fingers 57 are respectively interposed between successively adjacent pairs of hammers 54 in an interleaved fashion. Each of the fingers 57 defines a downwardly disposed notch 76. These notches 76 are dimensioned so as to allow the bumper 72 to force fit; that is, the bumper 72 is forced upwardly into the notch 76 during assembly of the print hammer mechanism.

When the hammer 72 is at its initial or nonprint position (FIG. 2) the leaf spring 60 biases the hammer 72 to the left to its rest position whereat a front inner edge 78 of the hammer slot is in contact with the adjacent wall of the bumper 72. As previously mentioned, the length of the slot 74 is dimensioned relative to the width of the bumper 72 so that a predetermined clearance is provided between an edge 80 of the slot 74 and the adjacent surface of the bumper 72 along the hammer path. This clearance or space indicated at 82 (FIG. 3) is chosen such that when the thickest number of plys or sheets of paper intended to be accommodated in the horizontal space identified by the numeral 83 (between the forward end of the given print hammer 54 and the front face of a type pallet as viewed in FIG. 2), the rearward edge 80 of the hammer slot 74 will just come into contact with a portion 84 of the bumper 72 when the hammer 54 reaches its print position. Thus, to the extent the thickness of the paper in the space identified by the numeral 83 is reduced from such a maximum count, each hammer will move further to the right (as viewed in FIG. 2) compressing the portion 84 of the bumper 72 by an increasing amount. The compression of the bumper reduces the printing force of the hammer 54 so that uniform print density will be obtained regardless of the number of plys being printed within, of course, the design parameters of the apparatus. Thus, the hardness characteristics of the material from which the bumper portion 84 is constructed is particularly important. Further, it is preferable that the material exhibits a high resiliency to afford the greatest resistance to changes in the characteristics of the material due to temperature variations. The selection of a material for bumper portion 84 having relatively high resiliency augments the action of the return spring 60 thus assuring rapid return of the hammer 72 to its rest position after completion of the printing operation. Thus, the bumper portion 84 exhibits sufficient hardness of compressibility to moderate the printing force of the print hammer to accommodate variations in the number of paper plys being printed as well as relatively high resiliency to exhibit relatively little change in hardness characteristics over temperature extremes and to augment the force of the return spring 60. A suitable material for use in forming the portion 84 of the bumper 72 is a cast urethane elastomer sold by E. I. du Pont Nemours Co. under the trademark ADIPRENE L-100 which has a durometer Shore hardness of 10A to 20A and a rebound efficiency of approximately 80%.

Figure 4:
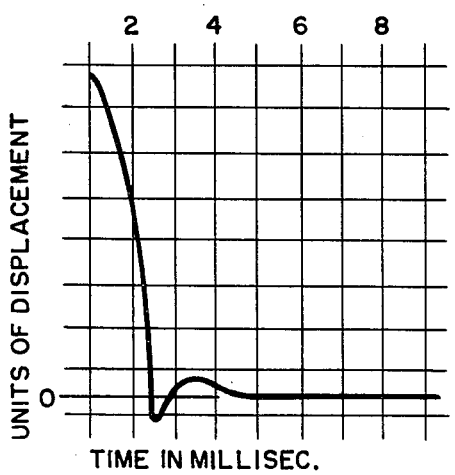
FIG. 4 is a graph of the vertical rebound over time of an object dropped from a height onto a sample of the material forming a portion of the print hammer bumper of FIG. 1.

In response to the firing of a selected hammer, the kinetic energy impacts the hammer 54 against the ribbon 50, web 42, pallet 16 combination and against the biasing force of the leaf spring 60. After impact by the pallet 16 with the paper 42, each hammer 54 is rapidly propelled to the left and retained in the rest position by the spring 60. This position is effected by the forward edge 78 of the slot 74 of each rebounding hammer impacting against the adjacent wall of a rebound portion 86 of the bumper 72. As previously mentioned, the bumper portion 86 serves to dampen the rebound energy of the hammers 54 which energy would otherwise result in the previously described phenomenon of character ghosting. To prevent such an occurrence, the bumper 72 should be capable of rapidly dampening all energy of the rebounding hammers 54 so that they quickly attain their resting state in preparation for the next firing, which may occur within a fraction of a second in a high speed printing operation. To obtain such a condition, it has been found that the resiliency of the rebound portion 86 of the bumper 72 against which the edge 78 of the print hammer 54 strikes preferably exhibits a relatively low resiliency. The rebound portion 86 of the bumper 72 should have the ability to absorb energy without permanent deformation and to thereafter restore itself upon release of the force by dissipating the absorbed energy in the form of heat. Additionally, it is desirable that the material be relatively hard so as to resist permanent deformation which may be caused by the hammer being biased against the bumper portion 86 during rest. It has been found that a material exhibiting a durometer Shore hardness in the range of A60 to A95 with an impact resilience by vertical rebound reading in the range of 5% to 20% with 10% being satisfactory. A particular material suitable for the absorption of the hammer rebound force has been found to be a cast urethane elastomer sold by the E. I. du Pont de Nemours Co. under the tradename ADIPRENE L-100. The resilience characteristics of this selected material, of which bumper portion 86 is preferably fabricated, are illustrated in graphic form in FIG. 4 wherein the ordinate is in relative units of vertical rebound of an object dropped upon a specimen of the material and the abscissa in milliseconds of time.

A preferred method of fabricating such a dual resiliency bumper is by centrifugal casting. A measured amount of the low resiliency material is first introduced into the mold followed by a measured fluid amount of material having the desired hardness and resiliency characteristics of bumper portion 84. The two ADIPRENE L-100 urethanes having the previously mentioned characteristics are rotated in the mold at a high speed. The materials fill the molding cavity by centrifugal force with the more dense material having the greater Shore hardness migrating to the outside of the mold. After the material cures it is removed from the mold with the two urethane materials being bonded together forming a dual resiliency bumper. For further information concerning the characteristic properties of ADIPRENE L-100 the reader's attention is directed to the following publications published by E. I. du Pont de Nemours Co. entitled "ADIPRENE L-100 A Liquid Urethane Elastomer" (Bulletin No. 7, October 1965) by R. J. Atherz, J. G. DiPinto, and J. M. Keegan; and "Engineering Properties of Urethane Elastomers" (A-29569-4m-1-63) by J. G. DiPinto and S. D. McCready.

A unique bumper 72 for a high speed on-the-fly printer 10 has been disclosed which serves not only to quickly dampen the rebound force of the returning print hammers 54 but also to adjust the forward printing force of the hammers 54 to accommodate the number of web plys being printed thereby maintaining uniform print quality. Although the invention has been particularly shown and described with reference to a preferred embodiment thereof, it will be understood that various changes in form and detail may be made without departing from the scope and spirit of the invention.

What is claimed:

1. In an on-the-fly impact printer including a print hammer mechanism having a plurality of selectively actuable print hammers disposed in a lateral array with each hammer movable along a linear path for printing on a web composed of at least a single sheet of paper; the hammers exhibiting a forward movement directed toward the paper web during printing and a rebound movement produced by the abrupt termination of the forward hammer movement upon completion of a printing operation, an improved bumper mechanism for automatically adjusting the forward force of the hammer to the number of paper plys of the web and for damping the rebound energy of the hammer upon its return stroke comprising:

a unitary elongated resilient bumper positioned to engage each of said print hammers during their printing stroke and for engaging said print hammers upon the return stroke;

said unitary bumper defining a first portion fabricated of a first material for engaging each of the hammers during their printing stroke and exhibiting a hardness characteristic selected to reduce the forward impact force of each of the hammers upon the paper to that force necessary to produce an acceptable print upon each of the sheets in the web and having a first resiliency, and said unitary bumper defining a second portion fabricated of a second material for engaging each of said hammers during their return stroke and exhibiting a second resiliency lower than said first resiliency so as to quickly absorb the return forces of each hammer thereby greatly reducing the intensity and duration of the hammer rebound upon return to its nonprint condition.

2. The apparatus of claim 1 wherein each of said hammers defines an opening having first and second edges with said bumper positioned within the opening defined by each of said hammers so that said first edge of said opening strikes the first portion of said bumper during the forward or print stroke of said hammer and said second edge engages the second portion of said member during the rebound or return stroke of the hammer.

3. The apparatus of claim 2 wherein said first portion of said bumper has a Shore hardness characteristic in the range of 10A to 20A.

4. The apparatus of claim 3 wherein said second portion of said bumper exhibits a rebound efficiency of approximately five to twenty percent.

5. The apparatus of claim 4 wherein at least one of said bumper portions is a urethane elastomer.

6. The apparatus of claim 5 wherein both of said bumper portions are urethane elastomers.

7. The apparatus of claim 2 wherein said second bumper portion is fabricated of a urethane elastomer having a Shore hardness characteristic in the range of 60A to 95A and said first portion is fabricated of a urethane elastomer having a vertical rebound efficiency of approximately 80 percent.

8. The apparatus of claim 1 wherein said first portion of said bumper has a Shore hardness characteristic in the range of 10A to 20A and said second portion has a Shore hardness characteristic in the range of 60A to 95A.

9. The apparatus of claim 1 wherein said first and second bumper portions are constructed of a urethane elastomer.

* * * * *